US006960042B1

(12) United States Patent
Hsiao

(10) Patent No.: US 6,960,042 B1
(45) Date of Patent: Nov. 1, 2005

(54) VERSATILE MOP

(76) Inventor: Tien Jong Hsiao, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/036,696

(22) Filed: Jan. 18, 2005

(51) Int. Cl.[7] ..... A47L 1/08; A47L 13/26; A46B 11/02

(52) U.S. Cl. ..... 401/138; 401/188 R; 401/25; 401/139

(58) Field of Search ..... 401/137, 138, 401/140, 188 R, 25, 263

(56) References Cited

U.S. PATENT DOCUMENTS 6,497,525 B1 * 12/2002 Huang ..... 401/138
6,692,172 B1 * 2/2004 Hsu ..... 401/138
6,722,806 B2 * 4/2004 Kunkler et al. ..... 401/138

* cited by examiner

*Primary Examiner*—David J. Walczak

(57) ABSTRACT

A versatile mop comprises a main body, a mop head pivotally connected to the main body, a handle set connected to the main body, and a water storing unit mounted on the main body, whereby the versatile mop can eject water spouts for cleaning floors and windows.

11 Claims, 12 Drawing Sheets

VERSATILE MOP

FIELD OF THE INVENTION

The present invention relates to versatile mops, and more particularly to a versatile mop having a function of water spray, suitable for cleaning floors and windows.

BACKGROUND OF THE INVENTION

The tools used to clean the environment, such as a broom, a mop or a window washer, each has one function. Therefore, it is costly to buy a complete set of tools for complete house cleaning. Moreover, the tools also occupy a considerable space, which are then inconvenient to store.

A window washing device of the prior art comprises a scraper, a washing cloth layer, and a water container, whereby a user can firstly spray water on a piece of window glass and then wipe it with the scraper and the washing cloth layer. However, the concept is applied only to a window washing device and has yet to be used to design other cleaning tools.

SUMMARY OF THE INVENTION

Accordingly, the primary objective of the present invention is to provide a versatile mop having the function of spraying water, which is applicable not only to window washing but also to floor cleaning.

To achieve the above objective, the present invention discloses a versatile mop comprising a main body, a mop head pivotally connected to the main body, a handle set connected to the main body, and a water storing unit mounted on the main body, whereby the versatile mop can eject water spouts for cleaning floors and windows.

Furthermore, the mop comprises a main body being substantially a hollow shell containing a first piston, a piston cover and a first connecting tube, the main body having a connection section formed at one end thereof, the first piston further including a protruded tube for connecting the connection section, a first resilient part and a second piston being inserted into the protruded tube through the connection section, the protruded tube being provided with a first water inlet and a first water outlet, a second water inlet being disposed adjacent to the protruded tube, a front end of the second water inlet being further connected to a second water outlet, the first water inlet and the first water outlet being enclosed within a piston cover, the piston cover further comprising a third water inlet and a third water outlet, a second resilient part and a valve axle being installed between each of the group of the first water inlet and the first water outlet and the group of the third water inlet and the third water outlet, a first terminal of the first connecting tube being connected to the third water inlet of the piston cover, a second terminal of the first connecting tube being connected to the second water outlet of the second water inlet; a mop head; a handle set; and a water storing unit further comprising a water container for storing water and a water flow control unit, the water flow control unit consisting of in order a seal cap, a filtering valve, a commutating mount, a commutating cap, a first tube, a second tube and a third tube, a third resilient part and a valve axle being situating between the seal cap and the filtering valve, a fourth resilient part and a valve core being situating between the commutating mount and the commutating cap, a rolling ball being situating between the first tube and the second tube.

The various objects and advantages of the present invention will be more readily understood from the following detailed description when read in conjunction with the appended drawings.

DETAILED DESCRIPTION OF THE PREFERRED EMBODIMENTS

Figure 1:
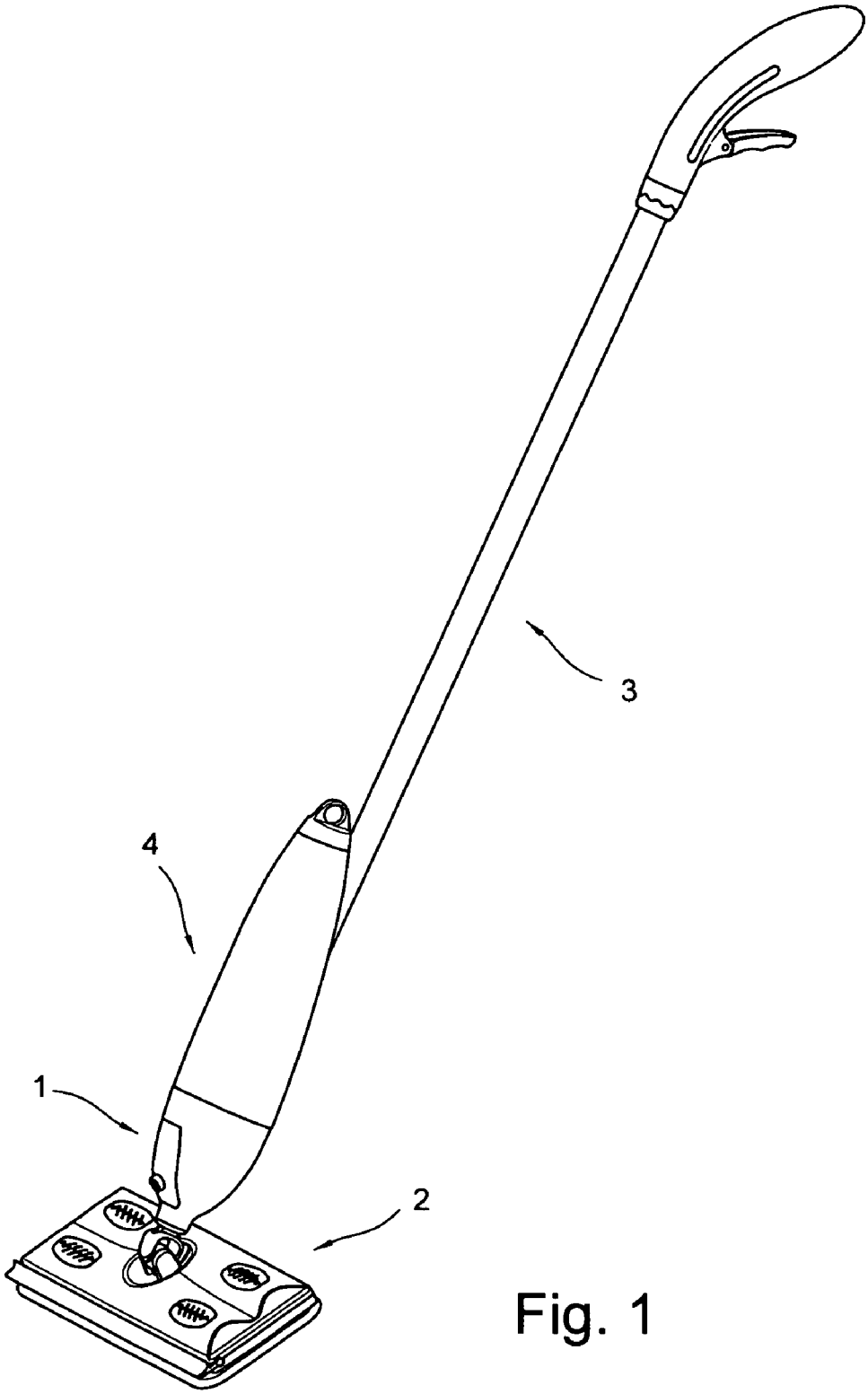
FIG. 1 is a perspective view of a versatile mop according to the present invention.

Referring to FIG. 1, a versatile mop according to the present invention comprises a main body 1, a mop head 2 pivotally connected to the main body 1, a handle set 3 connected to the main body 1, and a water storing unit 4 mounted on the main body 1, whereby the versatile mop can eject water spouts for cleaning floors and windows.

Figure 2:
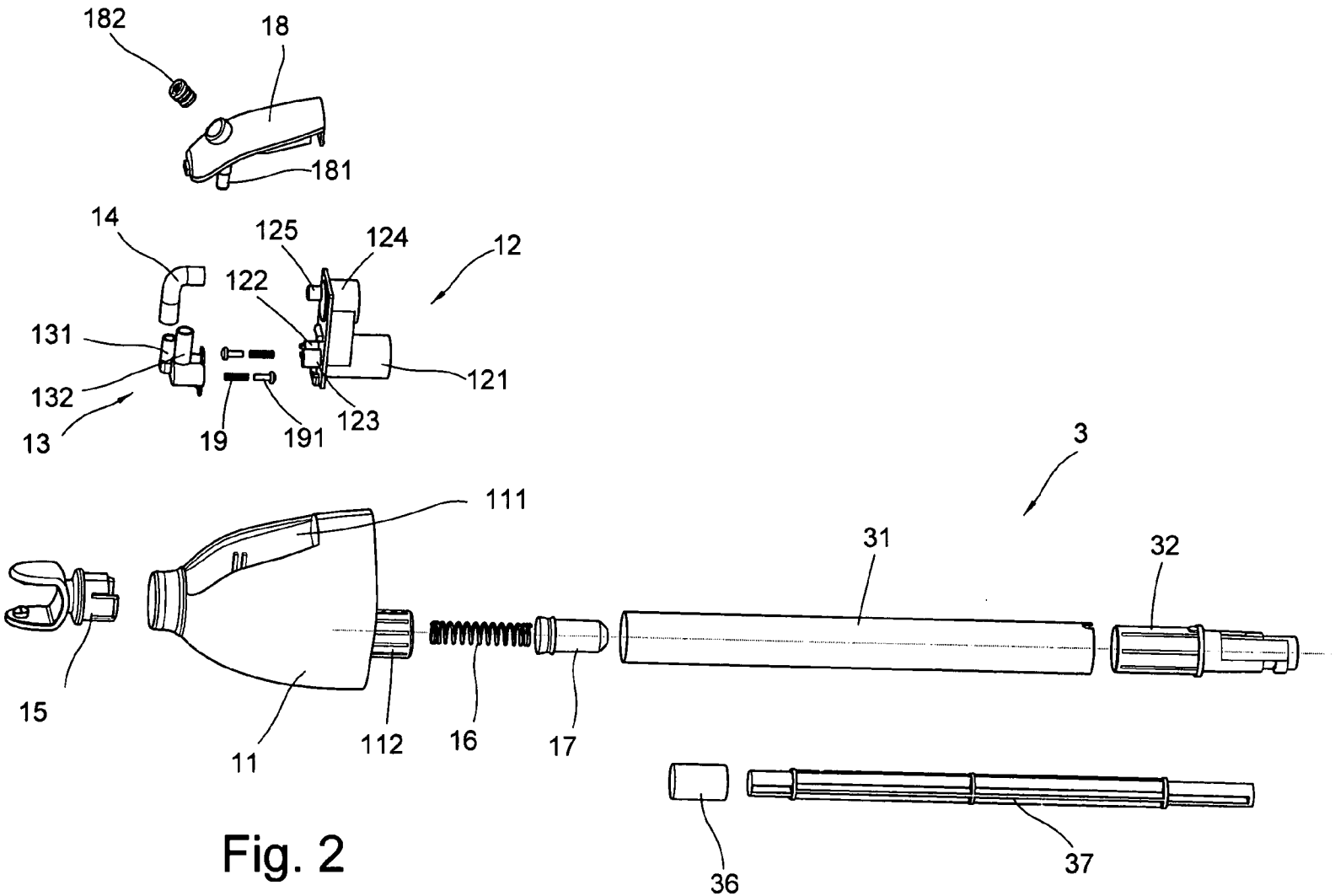
FIG. 2 is an exploded view of the versatile mop in FIG. 1.
Figure 3:
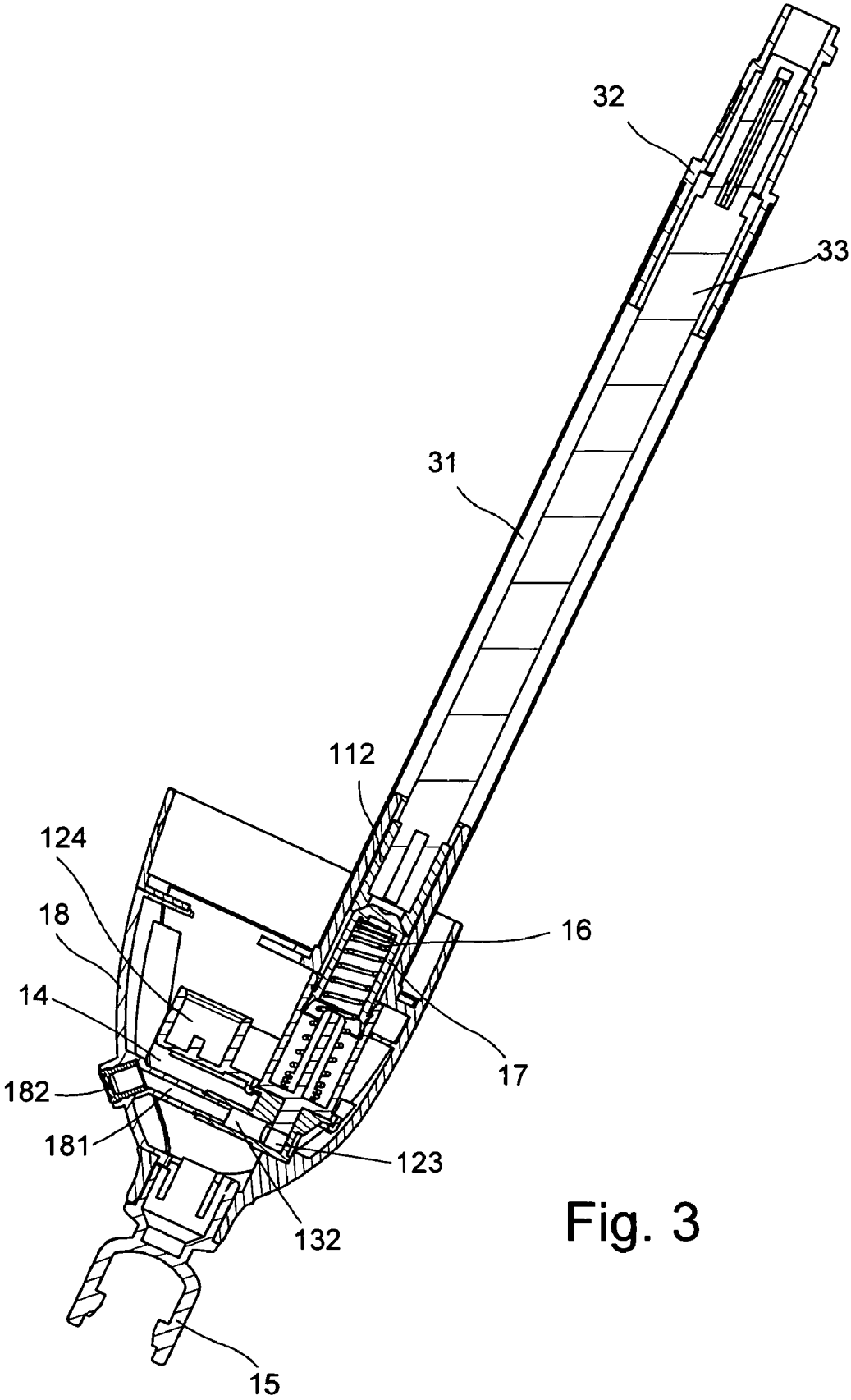
FIG. 3 is a lateral cross-sectional view of the main body 1 of the versatile mop in FIG. 1.

Referring to FIGS. 2 and 3, the main body 1 further comprises a hollow shell 11 with an opening 111 on a top wall thereof. At one end of the hollow shell 11, a connection section 112 for connecting a tubular section 31 of the handle set 3 is formed. The inner terminal of the connection section 112 is connected with the interior space of the hollow shell 11. A pivoting member 15 is mounted at another end of the hollow shell 11 for pivotally connecting the mop head 2. Further, a first piston 12, a piston cover 13 and a first connecting tube 14 are housed within the hollow shell 11. The first piston 12 further includes a protruded tube 121 for connecting the connection section 112. Further, a first resilient part 16 and a second piston 17 are inserted into the protruded tube 121 through the connection section 112. The protruded tube 121 is provided with a first water inlet 122 and a first water outlet 123. Adjacent to the protruded tube 121, there is a second water inlet 124, which has a second water outlet 125 connected to the inner space of the second water inlet 124. The first water inlet 122 and the first water outlet 123 are enclosed within a piston cover 13, which piston cover 13 is secured on the piston 12. The piston cover 13 further comprises a third water inlet 131 and a third water outlet 132. Between the pair of the first water inlet 122 and the first water outlet 123 and the pair of the third water inlet 131 and the third water outlet 132, there respectively exist a second resilient part 19 and a valve axle 191. One terminal of the first connecting tube 14 is connected to the third water inlet 131 of the piston cover 13, and the other terminal of the first connecting tube 14 is connected to the second water outlet 125 of the second water inlet 124. After installing the piston 12, the piston cover 13 and the first connecting tube 14 into the hollow shell 11, the opening 111 of the hollow shell 11 is sealed with an outer cover 18. The outer cover 18 is provided with a second connecting tube 181, one terminal of which is connected to the third water outlet 132 of the piston cover 13, and the other terminal of which is connected to a sprinkle-nozzle 182.

Figure 4:
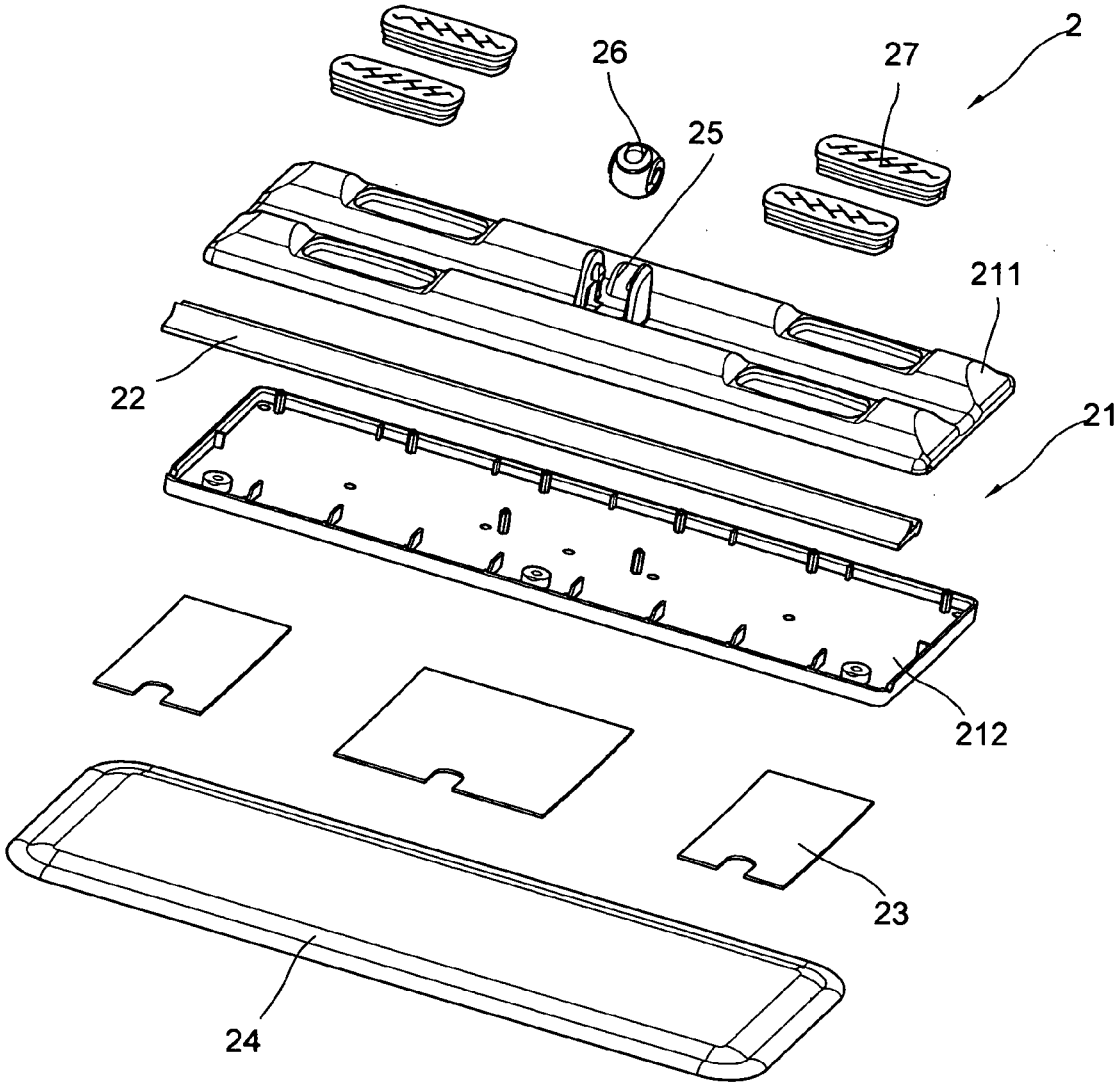
FIG. 4 is an exploded view of the mop head 2 of the versatile mop in FIG. 1.

Referring to FIG. 4, the mop head 2 further comprises a mop cloth mount 21, made of an upper board 211 and a lower board 212. A scraper 22 is sandwiched between the upper board 211 and the lower board 212 for cleaning glass panels of windows. The lower board 212 of the mop cloth mount 21 is further provided with a plurality of adhesive patches 23 for securing a mop cloth 24. The upper board 211 of the mop cloth mount 21 is further provided with a pivot receptacle 25 and a plurality of paper clip holes 27, whereby the pivot receptacle 25 can be connected to a pivot tube 26 for engaging the pivoting member 15 of the main body 1.

Figure 5:
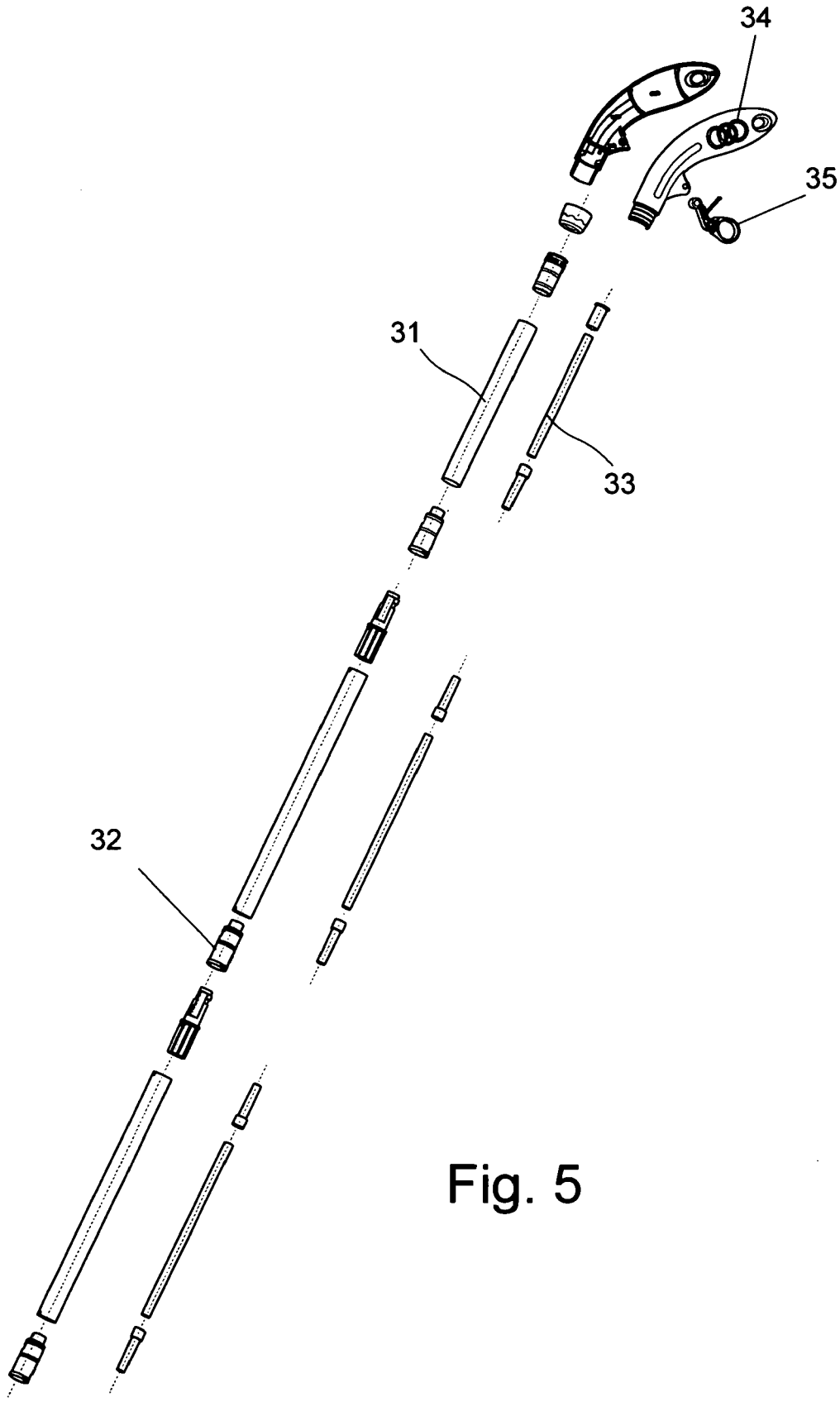
FIG. 5 is an exploded view of the handle set 3 of the versatile mop in FIG. 1.

Referring to FIGS. 2 and 5, the handle set 3 is composed of a plurality of outer tubes 31 that are connected by a plurality of connecting tubes 32, forming a single rod body. A plurality of linking axles 33 are enclosed within the rod body to form a linking mechanism, whereby a handle 34 at one end of the rod body will be connected to the connection section 112 of the main body 1. The handle 34 further includes a trigger unit 35 having one end inserted into the outer tube 31 adjacent to the handle 34 and pressing against the upper end of the linking mechanism. Thereby, pulling the trigger unit 35 will push the set of linking axles 33 downward so that the lower head of the linking mechanism can push the first resilient part 16 and the second piston 17. Consequently, the water stored in the water storing unit 4 will flow through the piston 12, the piston cover 13 and the first connecting tube 14, eventually ejected from the sprinkle-nozzle 182.

Figure 6:
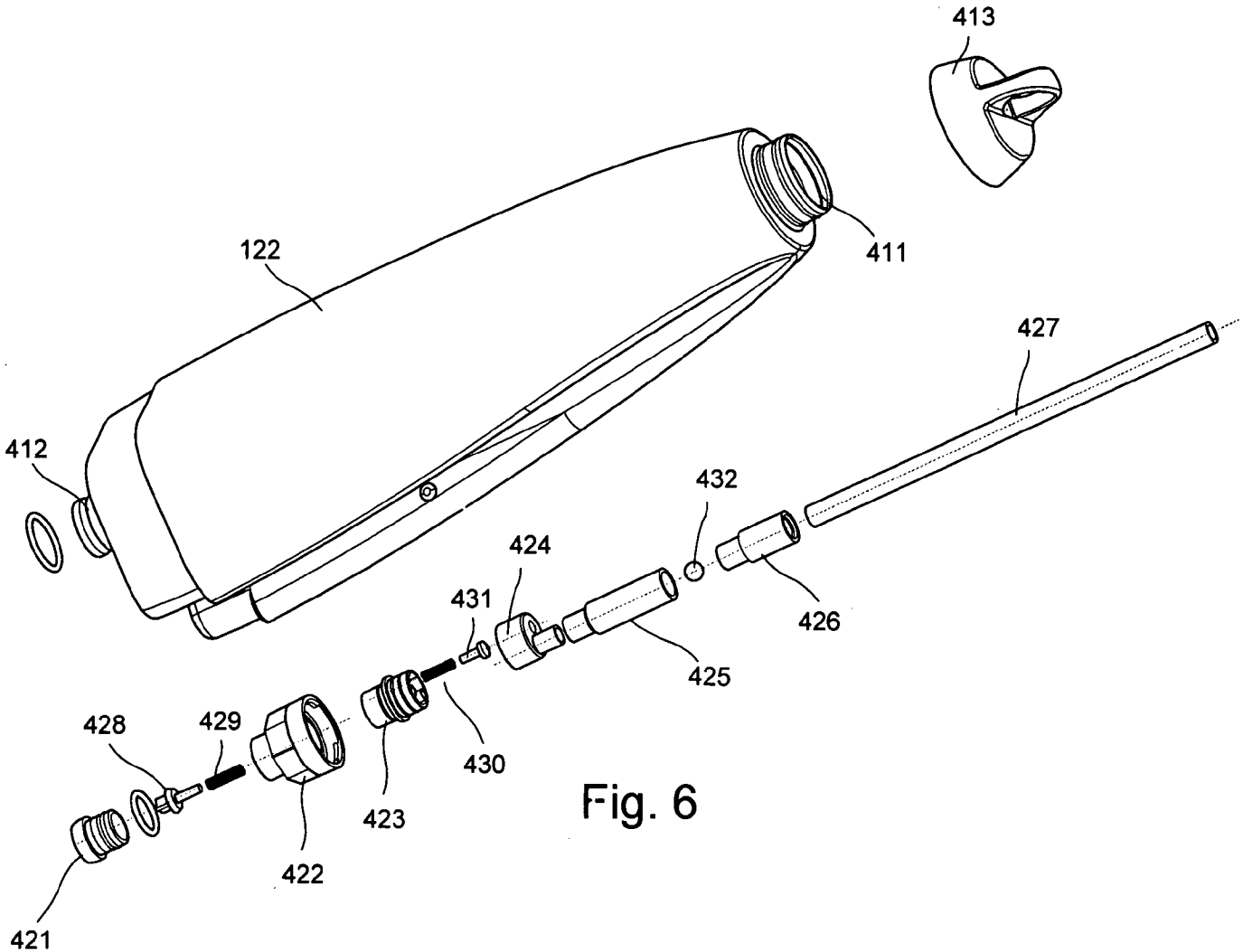
FIG. 6 is an exploded view of the water storing unit 4 of the versatile mop in FIG. 1.
Figure 7:
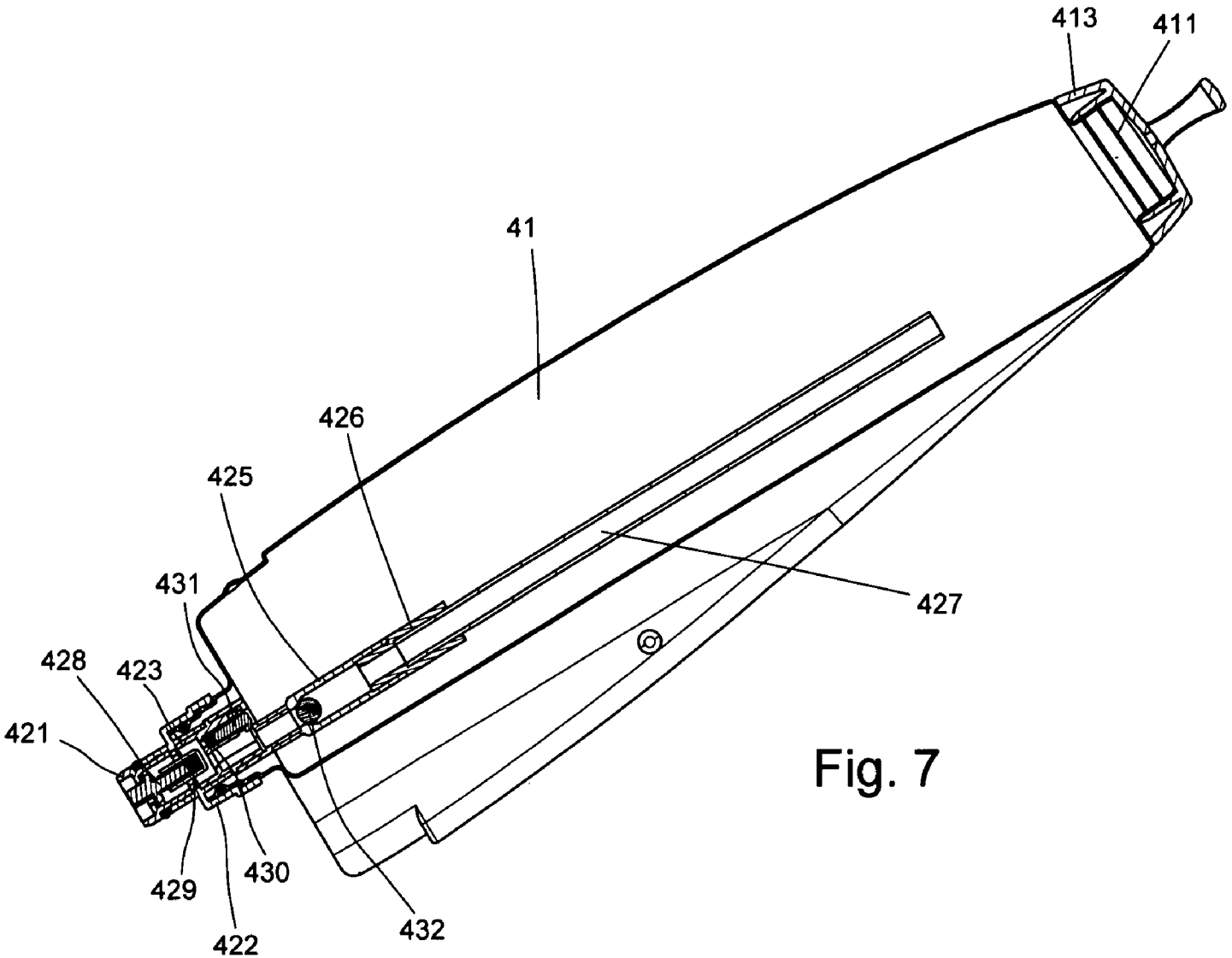
FIG. 7 is a lateral cross-sectional view of the water storing unit 4 of the versatile mop in FIG. 1.

Referring to FIGS. 6 and 7, the water storing unit 4 further comprises a water container 41 for storing water for a cleaning job and a water flow control unit. The water container 41 is provided with a water entrance 411 and a water exit 412, which water entrance 411 further includes a cap 413. The water flow control unit, which is mounted on the water exit 412, is formed by a seal cap 421, a filtering valve 422, a commutating mount 423, a commutating cap 424, a first tube 425, a second tube 426 and a third tube 427. There exists a third resilient part 429 and a valve axle 428 between the seal cap 421 and the filtering valve 422. There further exists a fourth resilient part 430 and a valve core 431 between the commutating mount 423 and the commutating cap 424. There exists a rolling ball 432 between the first tube 425 and the second tube 426. After all parts assembled, the water flow control unit will situate at the water exit 412, so that the water in the water container 41 will flow out through the water flow control unit 42.

Figure 8:
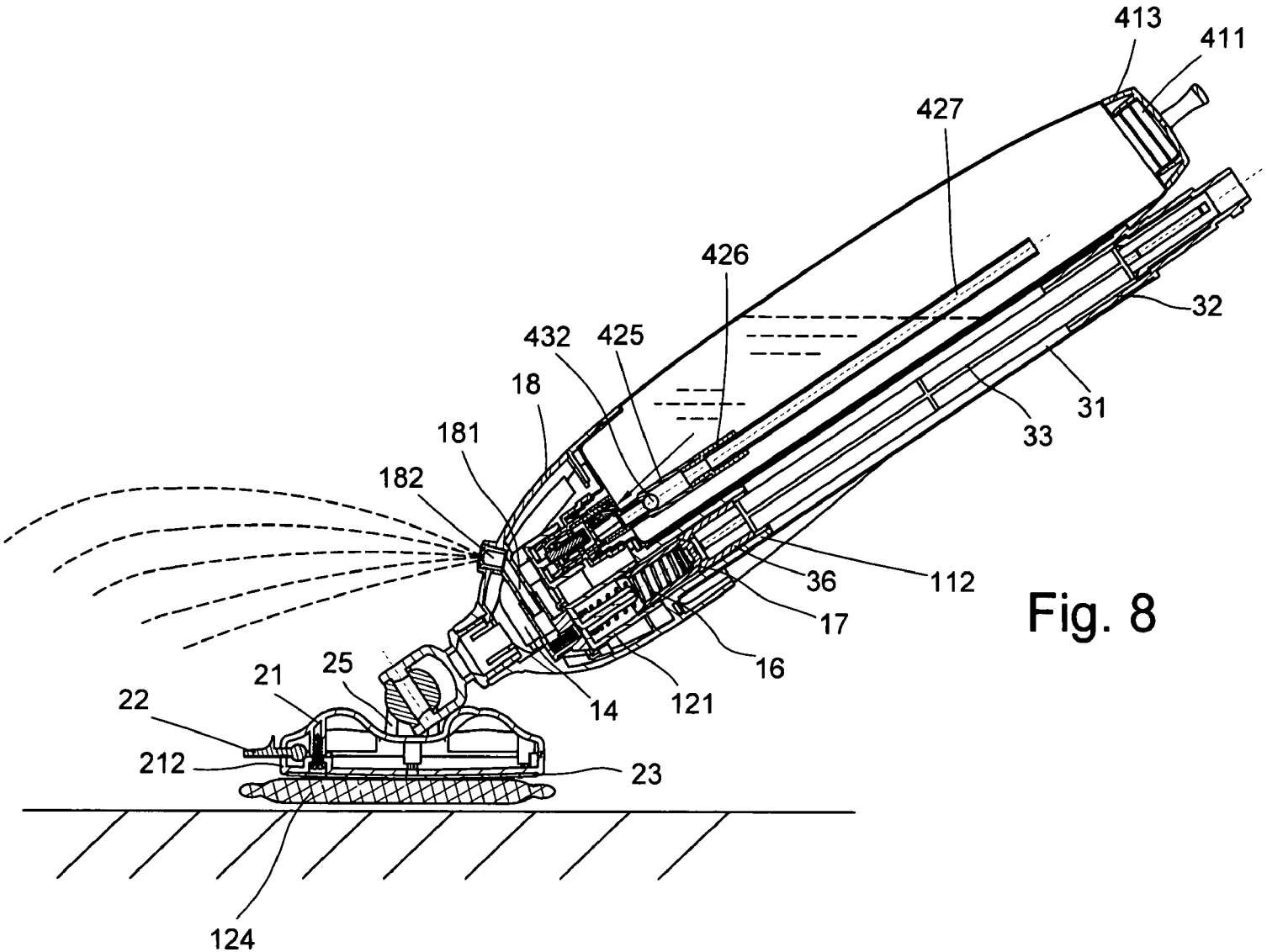
FIG. 8 is a lateral cross-sectional view of the versatile mop in FIG. 1, illustrating its usage.
Figure 9:
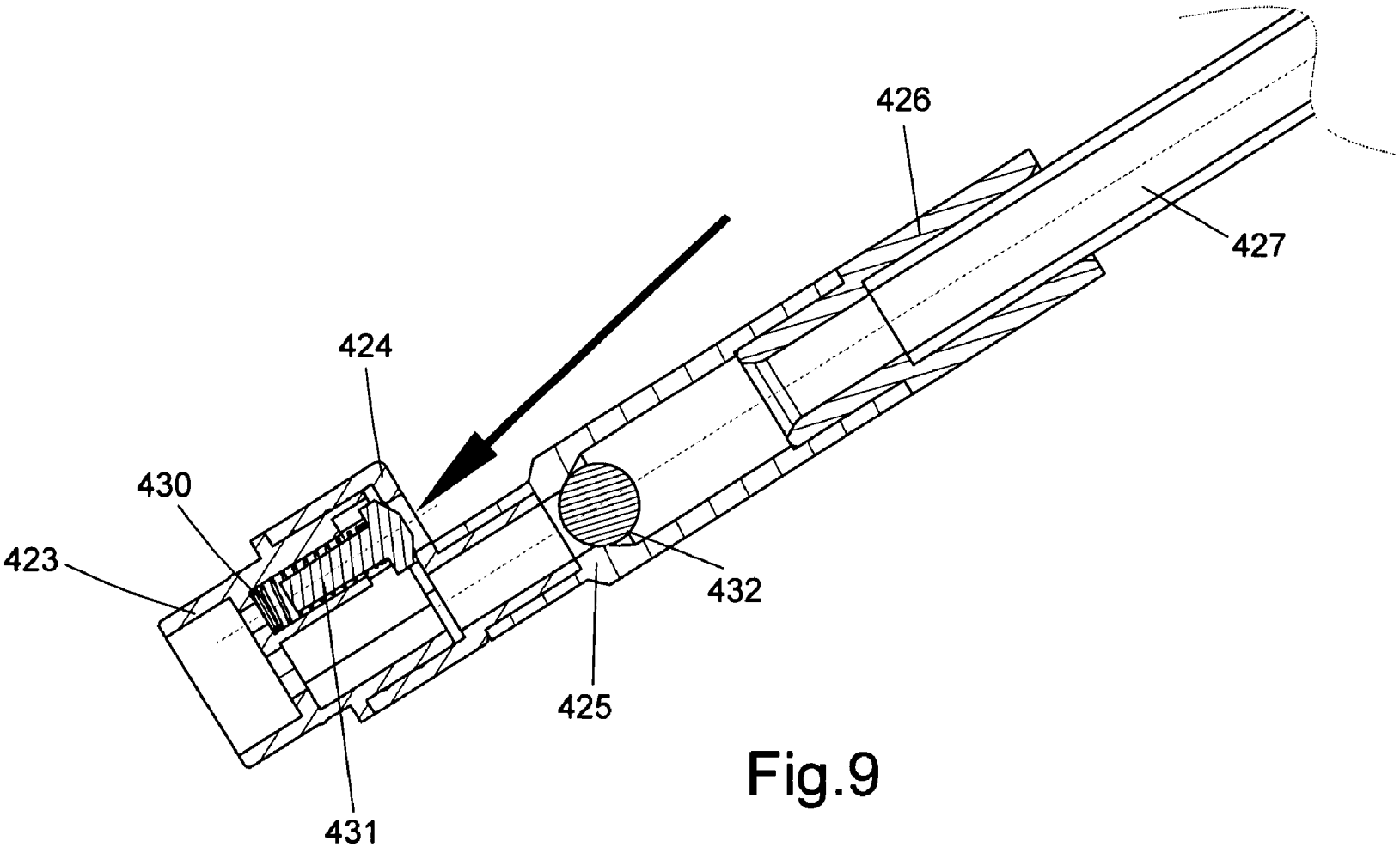
FIG. 9 is a local cross-sectional view of the handle set 3 of the versatile mop in FIG. 1, illustrating its usage.

Refer to FIGS. 8 and 9 for the usage of the versatile mop. The mop head 2 is placed on the ground so that it can be dragged over the ground. To provide water for the cleaning, the trigger unit 35 is pulled so as to move the linking axles 33 and the first resilient part 16 and the second piston 17, whereby the air in the first piston 12 and the piston cover 13 is released. As the trigger unit 35 is released, the restoring force of the second piston 17 pushes the second piston 17 upward, whereby the water in the water container 41 will be sucked through the commutating cap 424 and will open the valve core 431. As a consequence, the water will flow into the second water inlet 124 of the piston 12. The water will then flow out of the second water outlet 125 and flow through the first connecting tube 14 and the third water inlet 131 of the piston cover 13 and the first water inlet 122 of the piston 12, entering the protruded tube 121.

The trigger unit 35 is then pulled again, whereby the linking axles 33 will push the second piston 17 into the protruded tube 121. The water originally in the protruded tube 121 will be ejected through the first water outlet 123 into the third water outlet 132 of the piston cover 13 and then the connecting tube 181, eventually ejected from the sprinkle-nozzle 182 onto the ground and providing the water desired for the cleaning.

Figure 10:
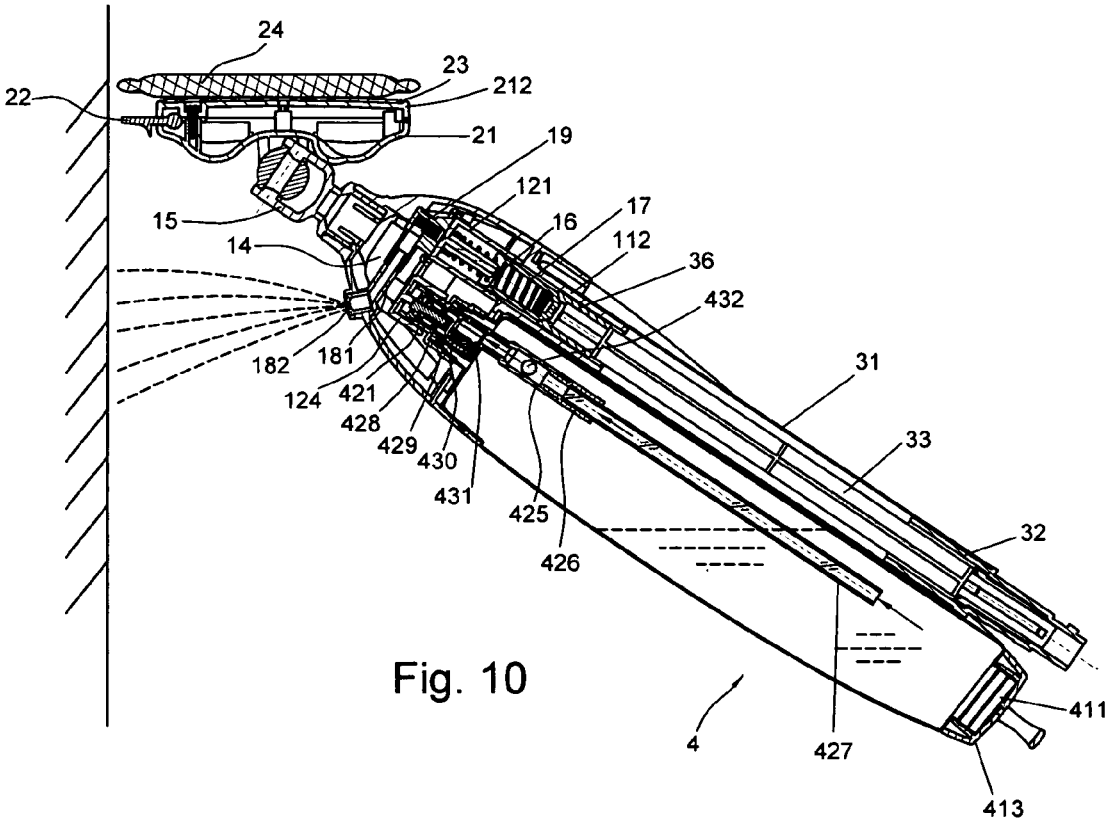
FIG. 10 is another lateral cross-sectional view of the versatile mop in FIG. 1, illustrating a different usage.
Figure 11:
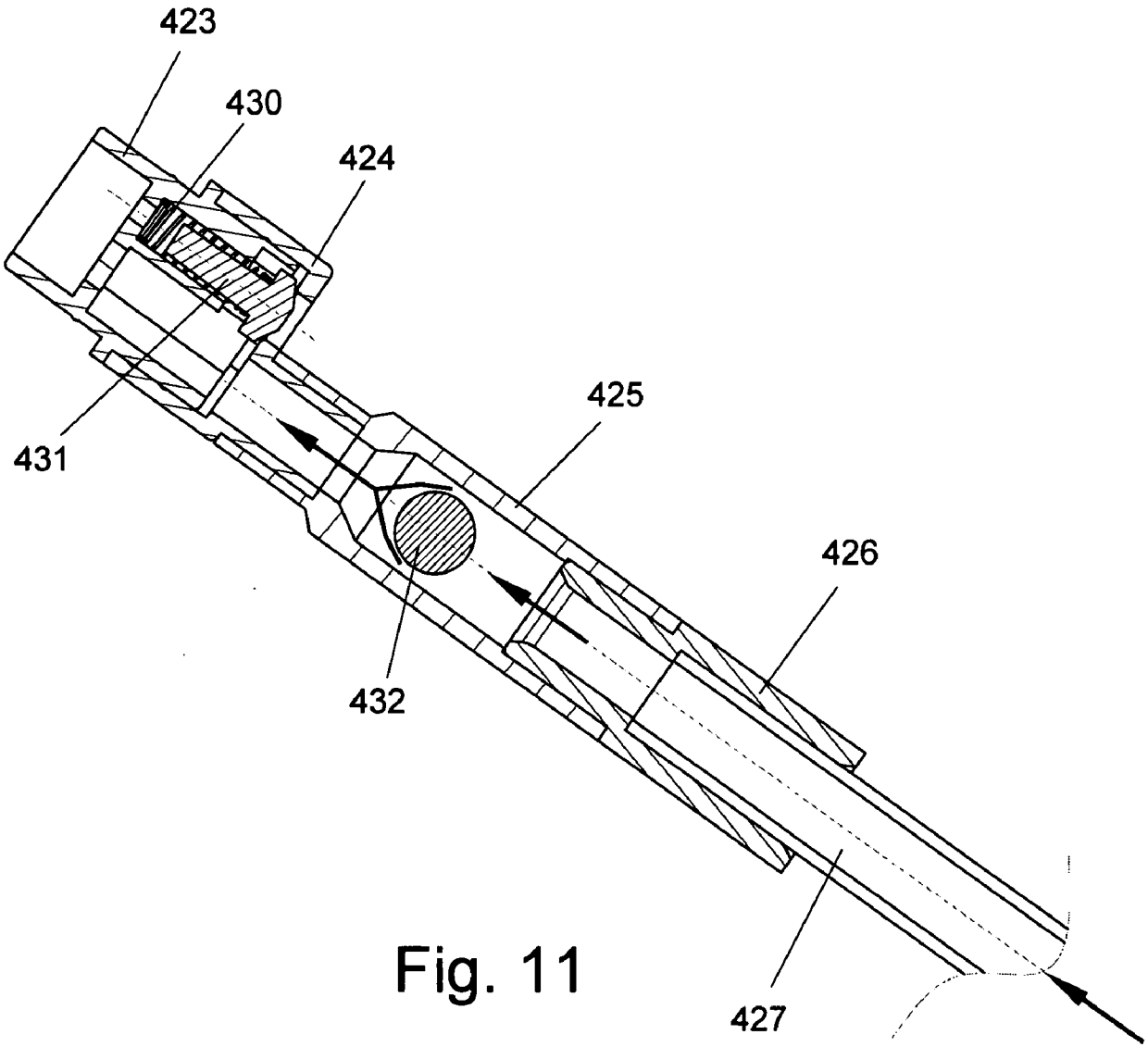
FIG. 11 is another local cross-sectional view of the handle set 3 of the versatile mop in FIG. 1, illustrating its usage.
Figure 12:
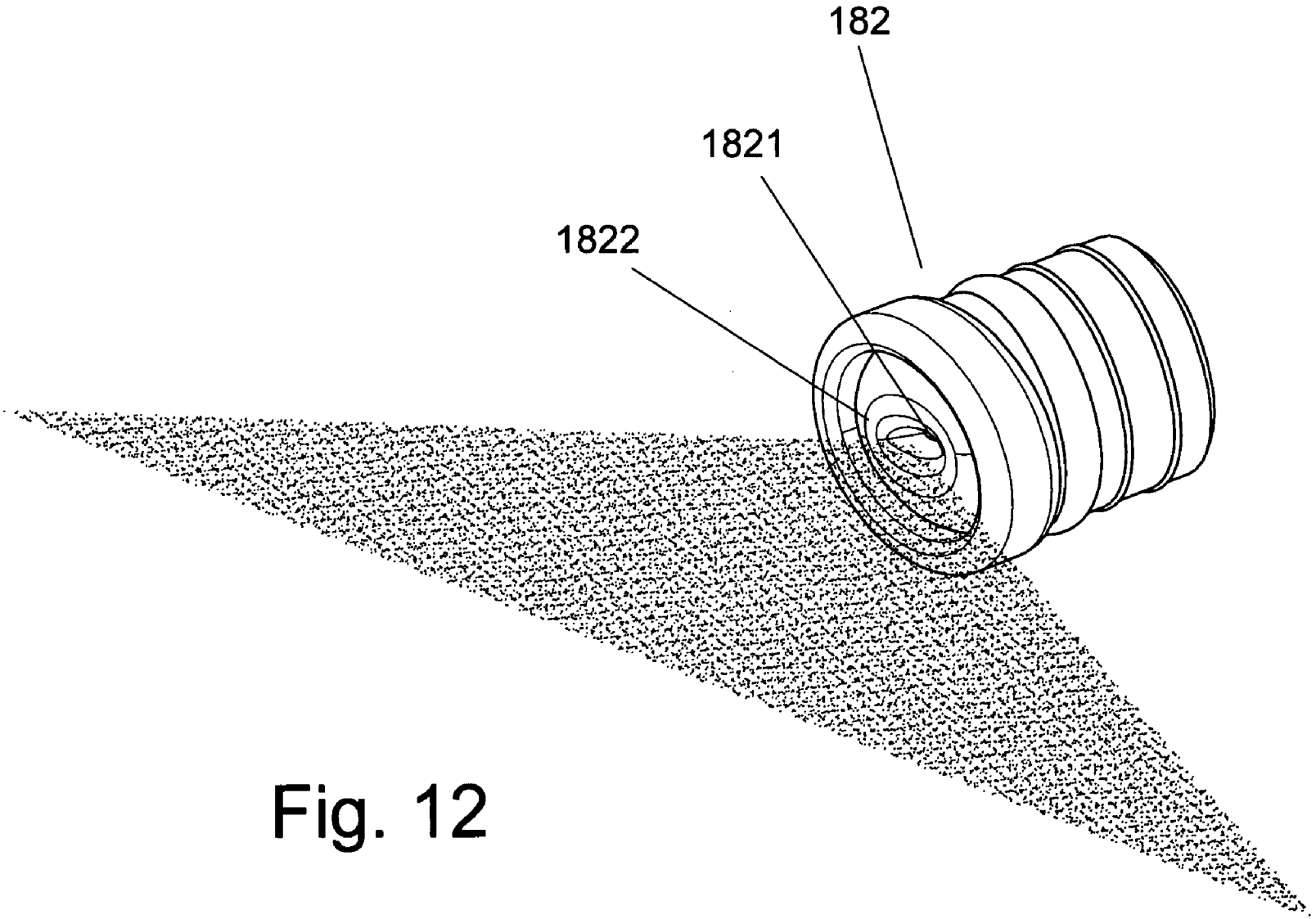
FIG. 12 is a local perspective view of the sprinkle-nozzle of the water storing unit 4 of the versatile mop in FIG. 1.

Referring to FIGS. 10 and 11, another usage of the versatile mop is for cleaning a window. Since the spring force exerted by the fourth resilient part 430 within the commutating mount 423 and the commutating cap 424 surpasses the hydraulic force produced by the water in between the third tube 427 and the rolling ball 432, the valve core 431, driven by the fourth resilient part 430 will close the water inlet on the bottom side of the commutating cap 424, producing a deficit in pressure within the first piston 12. Thereby, water will be sucked into the third tube 427 and, by overcoming the gravity of the rolling ball 432, will flow into the second tube 426, the first tube 425, the commutating cap 424 and the commutating mount 423. The water is then guided through the first piston 12 and the piston cover 13, eventually ejected from the sprinkle-nozzle 182 and sprayed on the window. The scraper 22 of the mop cloth mount 21 provides an extra cleaning effect over the window.

The sprinkle-nozzle 182 further includes an outlet of elliptic cross section 1821, wherein the exit opening is wider than the entrance opening. The outlet of elliptic cross section 1821 further comprises an arced rim 1822, whereby the water out of the sprinkle-nozzle 182 will form a horizontally extending sheet, and whereby the water spray is uniform.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A versatile mop, comprising:

a main body being substantially a hollow shell containing a first piston, a piston cover and a first connecting tube, said main body having a connection section formed at one end thereof, said first piston further including a protruded tube for connecting said connection section, a first resilient part and a second piston being inserted into said protruded tube through said connection section, said protruded tube being provided with a first water inlet and a first water outlet, a second water inlet being disposed adjacent to said protruded tube, a front end of said second water inlet being further connected to a second water outlet, said first water inlet and said first water outlet being enclosed within a piston cover, said piston cover further comprising a third water inlet and a third water outlet, a second resilient part and a valve axle being installed between each of the group of said first water inlet and said first water outlet and the group of said third water inlet and said third water outlet, a first terminal of said first connecting tube being connected to said third water inlet of said piston cover, a second terminal of said first connecting tube being connected to said second water outlet of said second water inlet;

a mop head;

a handle set; and a water storing unit further comprising a water container for storing water and a water flow control unit, said water flow control unit consisting of in order a seal cap, a filtering valve, a commutating mount, a commutating cap, a first tube, a second tube and a third tube, a third resilient part and a valve axle being situating between said seal cap and said filtering valve, a fourth resilient part and a valve core being situating between said commutating mount and said commutating cap, a rolling ball being situating between said first tube and said second tube;

whereby, as said versatile mop is tilted downward, a trigger unit of said handle set is pulled so as to drive a linking mechanism of said handle set to push said first resilient part and said second piston within said handle set, and whereby the air in said first piston and said piston cover will be squeezed out so that water can flow through said commutating cap and push said valve core open, and whereby water will then flow out of said second water outlet and flow through said first connecting tube and said third water inlet of said piston cover and said first water inlet of said first piston, eventually entering said protruded tube; and whereby, as said trigger unit is pulled again, said linking mechanism will push said second piston into said protruded tube, and whereby said water originally in said protruded tube will be ejected through said first water outlet into said third water outlet of said piston cover and then a second connecting tube, eventually ejected from a sprinkle-nozzle for cleaning a floor.

2. The versatile mop of claim 1, wherein said water container is for storing water and is further provided with a water entrance and a water exit.

3. The versatile mop of claim 2 wherein said water flow control unit is mounted on said water exit, and wherein said first tube, said second tube and said third tube are extended within said water container for guiding the water therein out of said water container.

4. The versatile mop of claim 1 wherein an opening of said hollow shell is sealed with an outer cover, said outer cover being provided with said second connecting tube, said second connecting tube having a first terminal connected to said third water outlet of said piston cover and a second terminal connected to said sprinkle-nozzle.

5. The versatile mop of claim 4 wherein said sprinkle-nozzle further includes an outlet of elliptic cross section having an exit opening wider than the entrance opening, said outlet of elliptic cross section further comprising an arced rim.

6. The versatile mop of claim 1 wherein said sprinkle-nozzle further includes an outlet of elliptic cross section having an exit opening wider than the entrance opening, said outlet of elliptic cross section further comprising an arced rim.

7. The versatile mop of claim 1 wherein said linking mechanism consists of a plurality of linking axles.

8. The versatile mop of claim 1 wherein a rod body of said handle set consists of a plurality of outer tubes.

9. The versatile mop of claim 8 wherein an upper surface of a mop cloth mount is provided with a plurality of paper clip holes.

10. The versatile mop of claim 1 wherein an end portion of said main body is connected to said mop head.

11. A versatile mop, comprising:

a main body being substantially a hollow shell containing a first piston, a piston cover and a first connecting tube, said main body having a connection section formed at one end thereof, said first piston further including a protruded tube for connecting said connection section, a first resilient part and a second piston being inserted into said protruded tube through said connection section, said protruded tube being provided with a first water inlet and a first water outlet, a second water inlet being disposed adjacent to said protruded tube, a front end of said second water inlet being further connected to a second water outlet, said first water inlet and said first water outlet being enclosed within a piston cover, said piston cover further comprising a third water inlet and a third water outlet, a second resilient part and a valve axle being installed between each of the group of said first water inlet and said first water outlet and the group of said third water inlet and said third water outlet, a first terminal of said first connecting tube being connected to said third water inlet of said piston cover, a second terminal of said first connecting tube being connected to said second water outlet of said second water inlet;

a mop head;

a handle set; and a water storing unit further comprising a water container for storing water and a water flow control unit, said water flow control unit consisting of in order a seal cap, a filtering valve, a commutating mount, a commutating cap, a first tube, a second tube and a third tube, a third resilient part and a valve axle being situating between said seal cap and said filtering valve, a fourth resilient part and a valve core being situating between said commutating mount and said commutating cap, a rolling ball being situating between said first tube and said second tube;

whereby, as said versatile mop is tilted upward for cleaning a window, said fourth resilient part within said commutating mount and said commutating cap will exert a spring force surpassing the hydraulic force produced by water between said third tube and said rolling ball, and whereby said valve core, driven by said fourth resilient part will close a water inlet on a bottom side of said commutating cap and produce a deficit in pressure within said first piston, and whereby water will be sucked into said third tube and, by overcoming said rolling ball's weight, will flow into said first tube, said commutating cap and said commutating mount, and whereby said water will then be guided through said first piston and said piston cover, eventually ejected from a sprinkle-nozzle and sprayed on the window, and whereby a scraper of a mop cloth mount of said mop head will provide an extra cleaning effect over the window.

* * * * *